US010787764B1

(12) United States Patent
Day

(10) Patent No.: US 10,787,764 B1
(45) Date of Patent: Sep. 29, 2020

(54) CLOTHING EJECTION NET FOR A WASHER OR DRYER AND METHOD OF EJECTING CLOTHING FROM A WASHER OR DRYER

(71) Applicant: Nathan Edward Day, Port St. Lucie, FL (US)

(72) Inventor: Nathan Edward Day, Port St. Lucie, FL (US)

( * ) Notice: Subject to any disclaimer, the term of this patent is extended or adjusted under 35 U.S.C. 154(b) by 0 days.

(21) Appl. No.: 16/443,801

(22) Filed: Jun. 17, 2019

(51) Int. Cl.
*D06F 95/00* (2006.01)

(52) U.S. Cl.
CPC ..... *D06F 95/006* (2013.01)

(58) Field of Classification Search
CPC ..... D06F 95/002; D06F 95/004; D06F 95/006
USPC ..... 383/2, 117
See application file for complete search history.

(56) References Cited

U.S. PATENT DOCUMENTS 2,038,993 A * 4/1936 Erlanger ..... D06F 95/006 210/237
4,109,397 A 8/1978 Daily
4,300,611 A * 11/1981 Silverman ..... D06F 95/004 108/136
5,220,734 A 6/1993 Carver
5,519,949 A 5/1996 Gibson, Jr.
6,067,723 A 5/2000 Lafrenz
6,134,810 A 10/2000 Stockley
6,212,792 B1 * 4/2001 Bier ..... D06F 58/04 34/109
7,661,203 B2 2/2010 Fumagalli
2008/0226204 A1 9/2008 Sabounjian et al.
2015/0048081 A1 2/2015 Youssef et al.
2015/0203283 A1 7/2015 Speckmann
2017/0327997 A1 11/2017 Florence

* cited by examiner

*Primary Examiner* — Jes F Pascua
(74) *Attorney, Agent, or Firm* — Mark C. Johnson; Johnson Dalal

(57) ABSTRACT

A clothing ejection net for a washer or dryer and method of ejecting clothing from a washer or dryer. The clothing ejection net comprises a net body that reconfigures between a retracted net configuration and an extended net configuration in relation to the interior of a metal drum of a washer or dryer. Magnets on the sidewalls of the net body magnetically attach the net body to the interior surface of the metal drum during washing and drying operations. A pull cord at the front face of the net body pulls the net body out of metal drum, to an extended net configuration. Magnets on the inner surface of the net sidewalls separate from magnets on the outside surface of the net body, creating a discrete snap separation to the extended net configuration. The extension of the net body ejects the clothing from the clothing retention cavity of net body.

20 Claims, 7 Drawing Sheets

CLOTHING EJECTION NET FOR A WASHER OR DRYER AND METHOD OF EJECTING CLOTHING FROM A WASHER OR DRYER

FIELD OF THE INVENTION

The present invention relates generally to a clothing ejection net for a washer and/or dryer and method of ejecting clothing from a washer or dryer, and, more particularly, relates to a net body that is operable to manually reconfigure between a retracted net configuration magnetically attached to the interior surface of a metal drum of a washer and/or dryer that receives clothing during washing and drying operations, and an extended net configuration that ejects the clothing from the metal drum.

BACKGROUND OF THE INVENTION

Typically, a washer and dryer are operable to wash and dry soiled and wet clothing, respectively. The washing machine comprises a deep, metal drum for receiving clothing to be treated, which is rotatably mounted within a tub. A water circuit including pumping means is provided for allowing washing water to be supplied to and drained from said tub. A soap insertion gate provides an inlet for introducing soap or drying products into the machine. The drying machine provides a metal drum that rotates and generates hot air during a normal drying cycle. The drum rotates as hot air traverses through the drum. The rotation of the drum causes the articles to continuously circulate through the drum which exposes more surface area to expedite drying.

Generally, the washing or drying machine drum that holds the clothing for washing or drying is deep and requires a user to bend down and reach in to deposit or retrieve the clothing. For both a top-loaded machine and a side-loaded machine, the clothing can be difficult to access for the elderly, or for users with back problems. Further, the clothing can stick to the sidewalls of the drum due to wetness or static electricity, making retrieval difficult.

Therefore, a need exists to overcome the problems with the prior art as discussed above.

SUMMARY OF THE INVENTION

The invention provides a clothing ejection net for a washer or dryer and method of ejecting clothing from a washer or dryer that overcomes the hereinafore-mentioned disadvantages of the heretofore-known devices and methods of this general type and a net body that manually reconfigures between a retracted net configuration and an extended net configuration in relation to the interior of a metal drum of a washer or dryer. A plurality of magnets on the sidewall of the net body magnetically attach the net body to the interior surface of the metal drum during washing and drying operations. A pull cord at the front face of the net body can be used to pull the net body out of the metal drum, to an extended net configuration. When pulled in such a manner, magnets on the inner surface of the net body sidewalls separate from magnets on the outside surface of the net body, creating a discrete snap separation to the extended net configuration. The extension of the net body in such a manner ejects the clothing from the clothing retention cavity of the net body. This easy-pull ejection facilitates removal of clothing from the metal drum of the washer or dryer.

With the foregoing and other objects in view, there is provided, in accordance with the invention, a clothing ejection net for a washer or dryer, comprising a net body that is detachably attachable to the interior surface of a washer metal drum and/or a dryer metal drum. The net body has a mesh net sidewall that is selectively configurable between an extended net configuration and a retracted net configuration from the interior surface of a metal drum in the washer or dryer. Both configurations of the net body are defined by a clothing retention cavity for receiving, retaining, and ejecting clothing directly from the net body.

The extended net configuration of the net body is disposed along a net translation path with the mesh net sidewall of a fabric material and is defined by a rear end, and a front end opposing the rear end of the mesh net sidewall. The mesh net sidewall is also defined by a front wall with a front wall surface, an outer surface, and an inner surface opposing the outer surface.

In some embodiments, the net body further includes a plurality of sidewall magnets that couple to the mesh net sidewall, and are disposed in a longitudinal orientation with respect to one another. The sidewall magnets are configured to detachably attach to the interior surface of the metal drum.

The retracted net configuration is disposed along the net translation path with the mesh net sidewall in a folded configuration having the plurality of magnets coupled to the mesh net sidewall. The sidewall magnets are each magnetically coupled to each other in an overlapping configuration and disposed in the longitudinal orientation to define, with a portion of the outer surface of the mesh net sidewall a clothing retention cavity.

In accordance with another feature, the retracted net configuration further comprises the front end of the mesh net sidewall disposed proximal to the rear end of the mesh net sidewall.

In accordance with another feature, each of the plurality of sidewall magnets further comprise a front surface and a rear surface opposing the front surface of the magnet, wherein the retracted net configuration includes the front surface of each of the plurality of sidewall magnets directly coupled together.

In accordance with another feature the plurality of sidewall magnets are formed in the shape of strips.

In accordance with another feature the folded configuration and the extended net configuration having the plurality of sidewall magnets disposed in a parallel configuration with respect to one another.

In accordance with another feature the mesh net sidewall further comprises at least one annular shaped magnet coupled thereto and disposed proximal to the rear end of the mesh net sidewall.

In accordance with another feature the plurality of magnets are circumferentially disposed around the mesh net sidewall in an equally and uniformly spaced configuration.

In accordance with another feature the front wall further comprises a plurality of front wall magnets coupled thereto. Each front wall magnet is disposed in a substantially perpendicular configuration and orientation with respect to the at least one of the plurality of magnets coupled to the mesh net sidewall.

In accordance with another feature, the net further comprises a pull cord with a first end directly coupled to the front wall of the net body and distal free end.

In accordance with a further feature, the mesh net sidewall further comprises a folding plane defined thereon and bisecting the mesh net sidewall into a drum coupling portion and a retracted portion, wherein the plurality of magnets disposed on the drum coupling portion are of a stronger magnetic field than the plurality of magnets disposed on the retracted portion.

In accordance with a further feature, the folding plane is defined by an approximate median of a longitudinal length of the mesh net sidewall defined by the rear and front ends thereon when in the extended net configuration.

Although the invention is illustrated and described herein as embodied in a Clothing Ejection Net for a Washer or Dryer and Method of Ejecting Clothing from a Washer or Dryer, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the net spanning from a rear end to a front end of the net body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
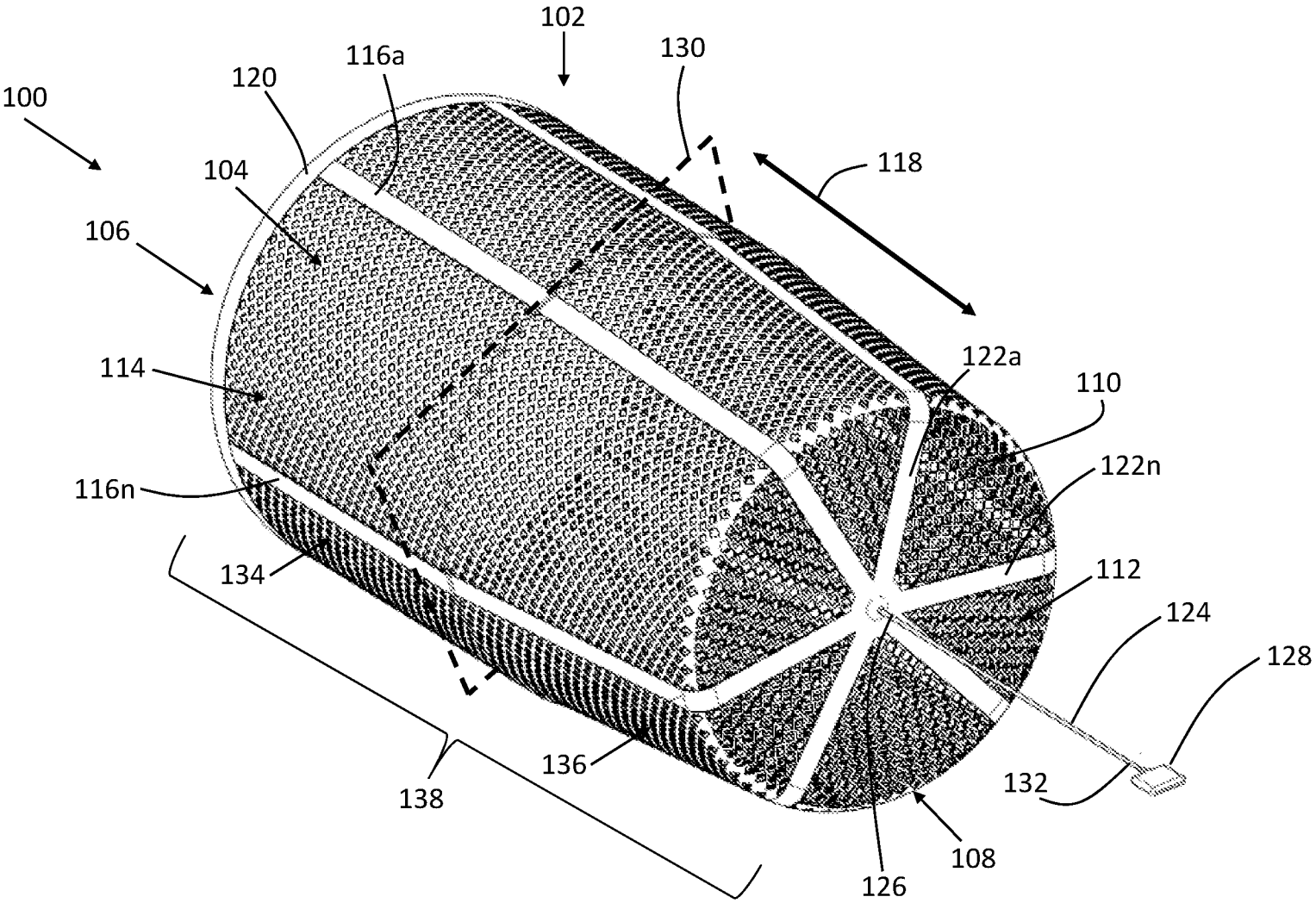
FIG. 1 is an isometric view of an exemplary clothing ejection net configured into an extended net configuration, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient clothing ejection net 100 for a washer or dryer and method 800 of ejecting clothing from a washer or dryer. Embodiments of the invention provide a net body that is selectively configurable between an extended net configuration and a retracted net configuration from the interior surface of a metal drum in the washer or dryer. In addition, embodiments of the invention provide a plurality of magnets that detachably attach the net sidewalls to the interior surface of the metal drum.

Figure 2:
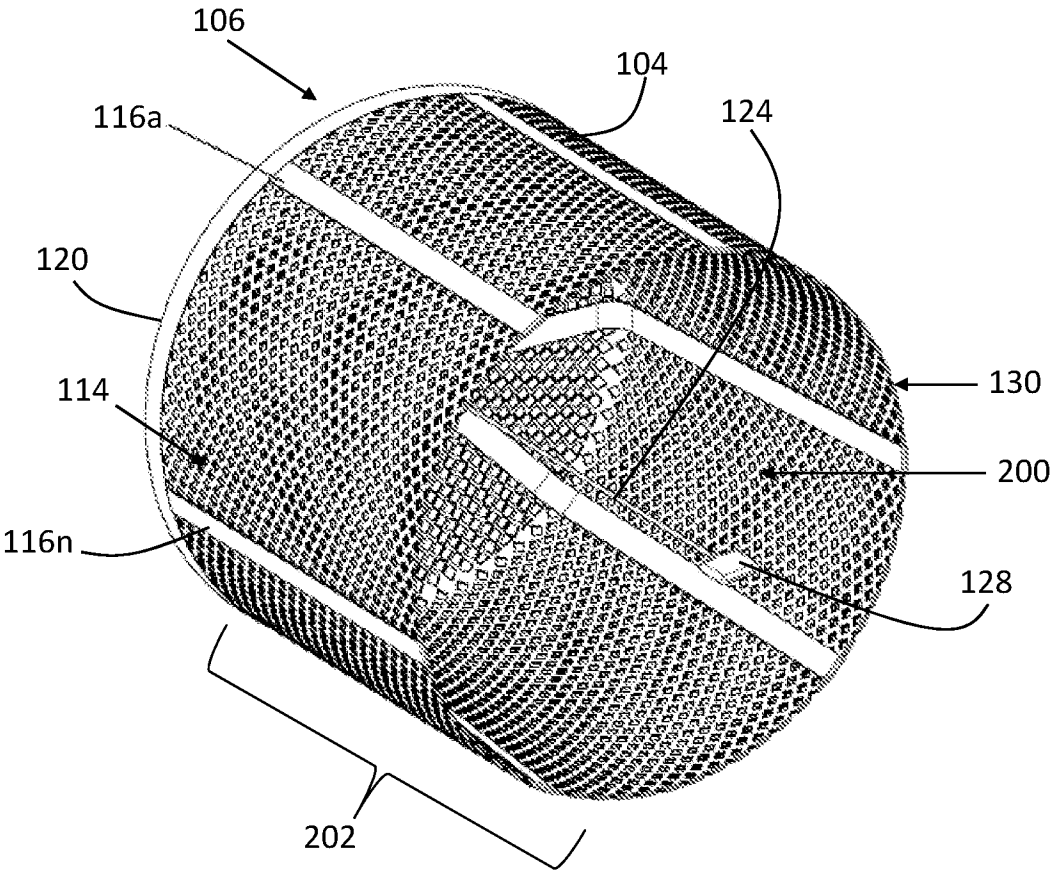
FIG. 2 is an isometric view of the clothing ejection net configured into a retracted net configuration, in accordance with the present invention.
Figure 7:
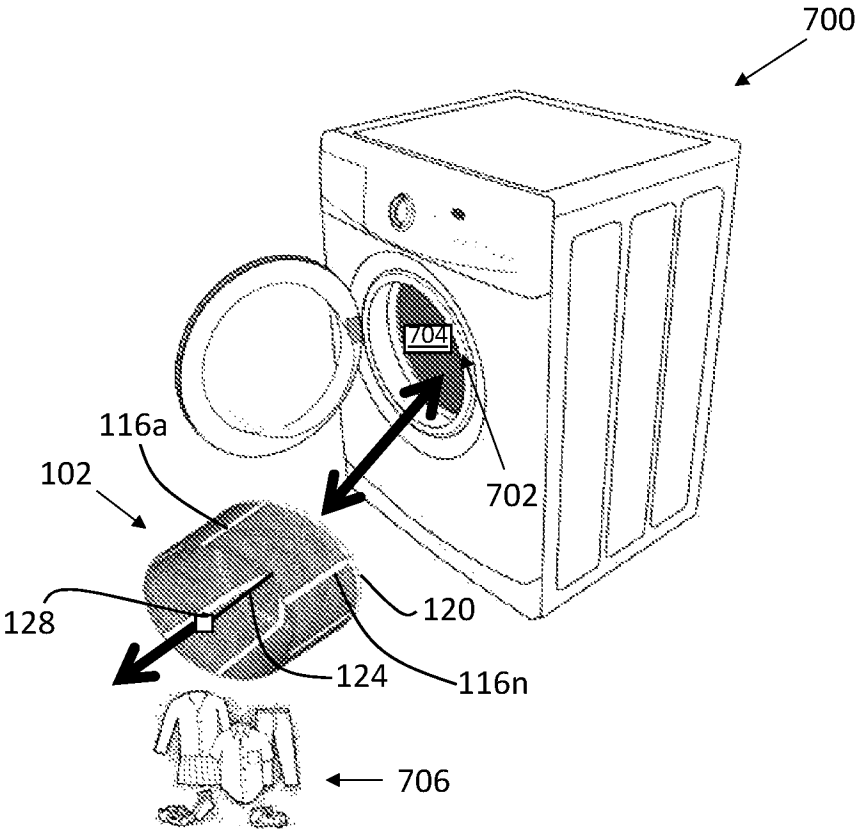
FIG. 7 is a perspective view of the clothing ejection net in relation to a metal drum for a dryer, in accordance with the present invention.

Referring now to FIG. 1, one embodiment of the present invention is shown in an isometric view. FIG. 1, along with other figures depicted herein, shows several advantageous features of the present invention, but, as will be described below, the invention can be provided in several shapes, sizes, combinations of features and components, and varying numbers and functions of the components. The first example of a clothing ejection net 100 for a washer or dryer, as shown in FIGS. 1-2 and FIG. 7, includes a net body 102 that includes a mesh net sidewall 104. The net body 102 defines a clothing retention cavity 200 that receives and retains clothing. The net body 102 is configured to magnetically fasten to an interior surface 704 inside a metal drum 702 of a washer or dryer 700 during washing and/or drying operations. The net body 102 is also configured to partially extend outside the metal drum 702, so as to selectively eject the clothing from the clothing retention cavity 200.

Looking again at FIG. 1, the net body 102 is defined by a generally cylindrical shape that is sized and dimension to pas through a passageway in the metal drum 702 for retention therein. The cylindrical shape of the net body 102 also provides a large surface area that allows water and/or hot air to engage the clothing disposed inside the retention cavity 200. The mesh net sidewall 104 may include connected strands of fiber, cotton, polyester, rubber, metal, ductile materials, flexible polymers, and combinations thereof, including elastic cloth fibers.

In some embodiments, the mesh net sidewall 104 is constructed from a fabric material and is defined by a rear end 106, a front end 108 opposing the rear end 106 of the mesh net sidewall 104, a front wall 110 with a front wall surface 112, an outer surface 114, and an inner surface 500 opposing the outer surface 114. The front end 108 forms a cap to the longitudinal of the mesh net sidewall 104, preventing the clothing 706 from premature removal from the clothing retention cavity 200. The rear end 106 is open and faces opposite the front end 108. In one alternative embodiment, the front wall 110 forms an aperture sized to receive a central axle of a washer metal drum. In this manner, the net body 102 can be fitted into the metal drum while in a retracted net configuration 202 and may also include one or more magnets defined around the aperture sized to receive the central axle.

One of the unique features of the net body 102 is the capacity to operably and selectively reconfigure between an extended net configuration 138 (FIG. 1), and a retracted net configuration 202 (FIG. 2) along a net translation path 118, i.e. folded-axial reconfiguration. The net translation path 118 follows an axial reconfiguration of the mesh net sidewall 104 about a folding plane 130. In one embodiment, the folding plane 130 is defined by an approximate median of a longitudinal length of the mesh net sidewall 104 defined by the rear and front ends 106, 108 thereon when in the extended net configuration 138. The folding plane 130 may bisect the mesh net sidewall 104 into a drum coupling portion 134 and a retracted portion 136. The drum coupling portion 134 is the portion of the net body 102 that magnetically attaches to the interior surface of the metal drum 702, remaining attached therein. The retracted portion 136 is the portion of the net body 102 that is pulled out of the metal drum, to eject the clothing 706 from the clothing retention cavity 200.

And thus, the clothing ejection net 100 is unique in utilizing magnetic forces to securely retain the net body 102 in the metal drum 702 of the washer or dryer 700 during washing and drying operations, and during ejection of the clothing 706. The used of magnets is efficient and conducive to the metallic fabrication of substantially all washers and dryers known in the art. Furthermore, magnetic attachability or coupling requires no tools or special skill set, making operational use of the clothing ejection net user-friendly and cost effective.

Figure 3:
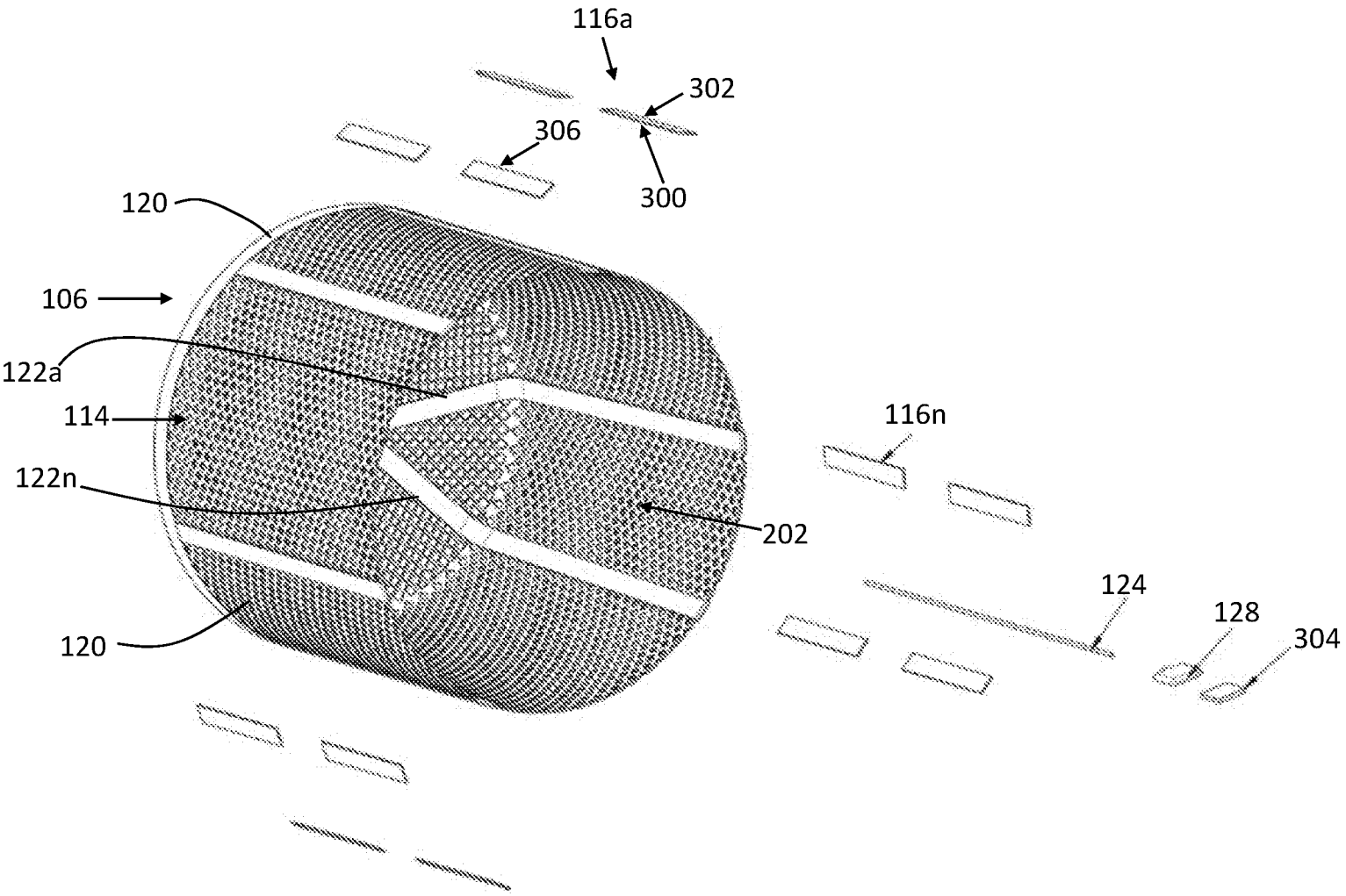
FIG. 3 is a blow-up view of the clothing ejection net, showing the magnets, magnet covers, and pull cord, in accordance with the present invention.

As illustrated in FIG. 3, the clothing ejection net 100 comprises a plurality of sidewall magnets 116*a-n* that couple to the mesh net sidewall 104. The sidewall magnets 116*a-n* are disposed in a longitudinal orientation with respect to one another, extending from the front wall 110 to the rear end 106 of the sidewall 104. In one non-limiting embodiment, the sidewall magnets 116*a-n* formed in the shape of strips that are bendable along the longitudinal. The sidewall magnets 116*a-n* are circumferentially disposed around the mesh net sidewall 104 in an equally and uniformly spaced configuration. Each sidewall magnet comprises a front surface 300, and a rear surface 302 that opposes the front surface 300 of the sidewall magnet. Furthermore, the relationship of the retracted net configuration 202 and the extended net configuration 138 are such that the sidewall magnets 116*a-n* are disposed in a parallel configuration with respect to one another in the retracted net configuration 202.

Figure 5:
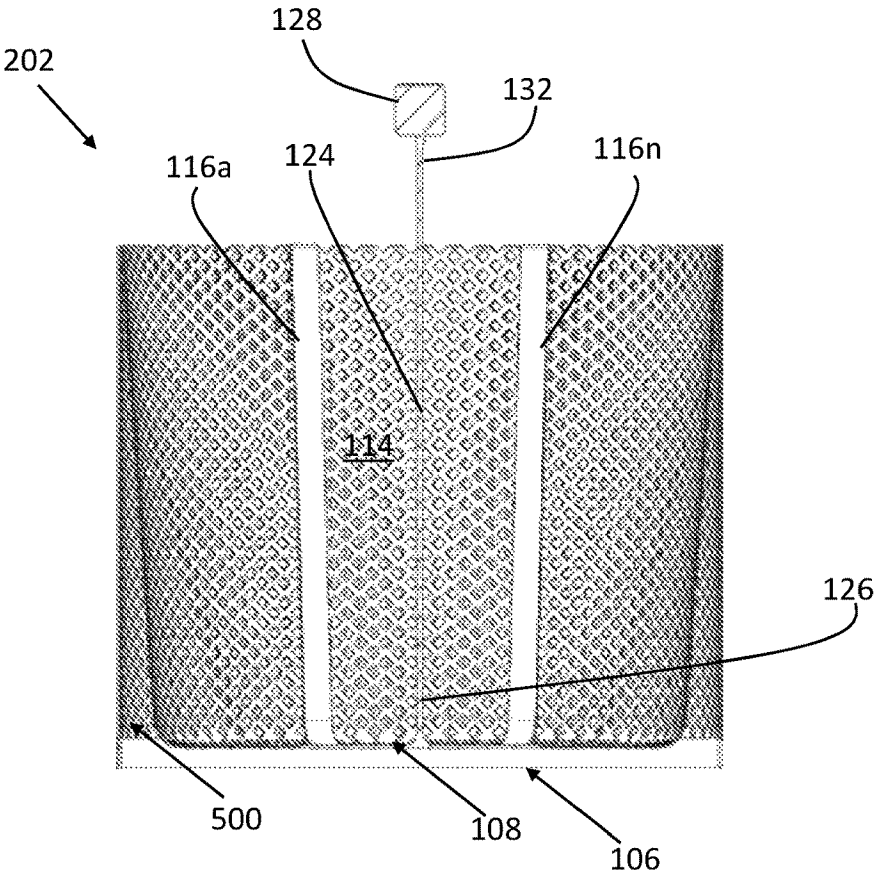
FIG. 5 is an elevated side view of the clothing ejection net, showing the inner surface of the mesh net sidewall, in accordance with the present invention.
Figure 4:
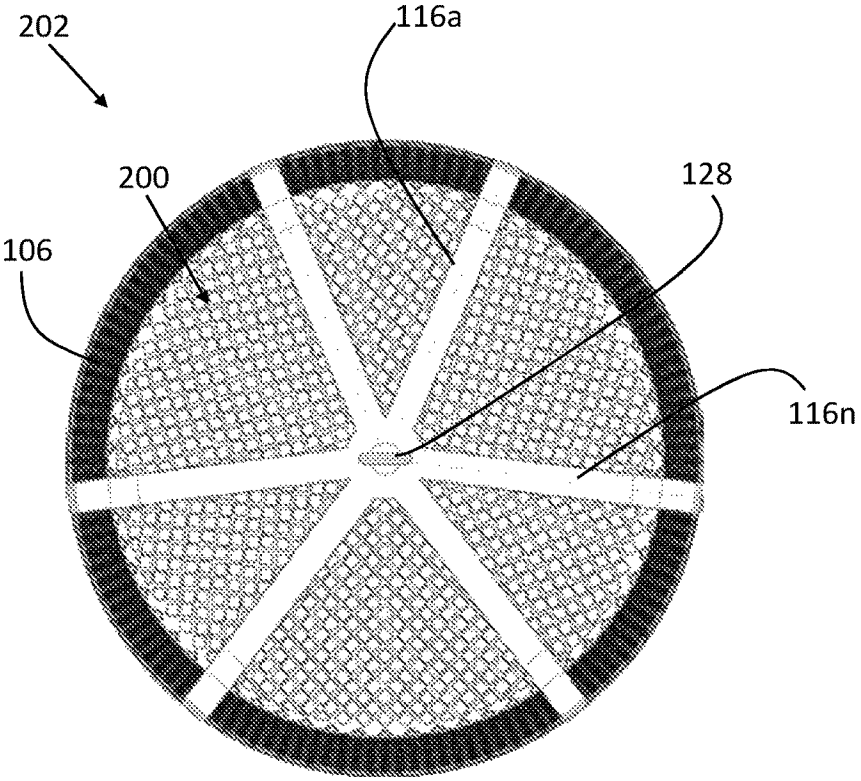
FIG. 4 is a bottom view of the clothing ejection net, showing the clothing retention cavity, in accordance with the present invention.

In the retracted net configuration 202 shown in FIG. 4, the front end 108 of the mesh net sidewall 104 is disposed proximal to the rear end 106 of the mesh net sidewall 104. In one embodiment, there may be an approximate 1"-2" distance between the rear and front ends 106, 108 (FIG. 5) when in the retracted net configuration 202. Also, in the retracted net configuration 202, the front surface 300 of each of the sidewall magnets 116*a-n* directly couple together in an overlapping configuration. The sidewall magnets 116*a-n* are disposed in the longitudinal orientation to define, with a portion of the outer surface of the mesh net sidewall 104, the clothing retention cavity 200.

In the extended net configuration 138, the section of the sidewall magnets 116*a-n* at the drum coupling portion remain magnetically attached to the interior surface of the metal drum, and the section of the sidewall magnets 116*a-n* at the retracted portion 136 are pulled away to extend outside the metal drum for ejecting the clothing. The front wall 110 is pulled out, separating from the rear end 106, to form the extended net configuration 138.

In some embodiments, the sidewall magnets 116*a-n* on the drum coupling portion 134 of the net body 102 are of a stronger magnetic field than the sidewall magnets 116*a-n* on the retracted portion of the net body 102. By way of example, the plurality of sidewall magnets 116*a-n*, which are preferably permanent magnets, that are disposed on the drum coupling portion may be approximately 0.15-0.25 Tesla; while the plurality of sidewall magnets 116*a-n* that are disposed on the retracted portion may be approximately 0.5-0.2 Tesla.

This stronger magnetic force at the drum coupling portion 134 allows the net body 102 to securely attach to the interior surface of the metal drum 702 while in the retracted net configuration 202. Thus, as the metal drum 702 rotates, agitates, and vibrates, the relatively stronger magnetic forces along the rear end 106 of the mesh net sidewall 104, retain the net body 102 in place. The stronger magnets at the drum coupling portion 134 also works to support the weight of the clothing 706 that are drawn by centrifugal forces in the metal drum 702 to the rear end 106 of the mesh net sidewall 104.

Conversely, the lesser magnetic strength of the sidewall magnets 116*a-n* at the retracted portion 136 of the mesh net sidewall 104, facilitates the act of pulling out the front wall 110 (with the pull cord 124) to the extended net configuration 138. And looking again at FIG. 3, a sidewall magnet cover 306 may also be used to encapsulate the sidewall magnets. The sidewall magnet cover 306 forms an insulative layer that helps prevent the sidewall magnets 116*a*, 116*n* from burning the user during operation of the net body 102.

Additional magnets used in the present invention include a plurality of front wall magnets 122*a-n* that couple to the front wall 110. Each front wall magnet 122*a-n* is disposed in a substantially perpendicular configuration and orientation with respect to the sidewall magnets 116*a-n* coupled to the mesh net sidewall 104. Additionally, at least one annular shaped magnet 120 couples to the mesh net sidewall 104. The annular shaped magnet 120 is disposed proximal to the rear end 106 of the mesh net sidewall 104. Thus, in the retracted net configuration 202, the front wall magnet 122*a-n* forms a magnetic attraction to the annular shaped magnet 120. The magnetic attraction between the rear and front ends 106, 108 of the mesh net sidewall 104 is broken by pulling on a pull cord 124 that attaches to the front wall 110 of the mesh net sidewall 104. Pulling on the front wall 110 in this manner forms the extended net configuration 138 described above.

Figure 6:
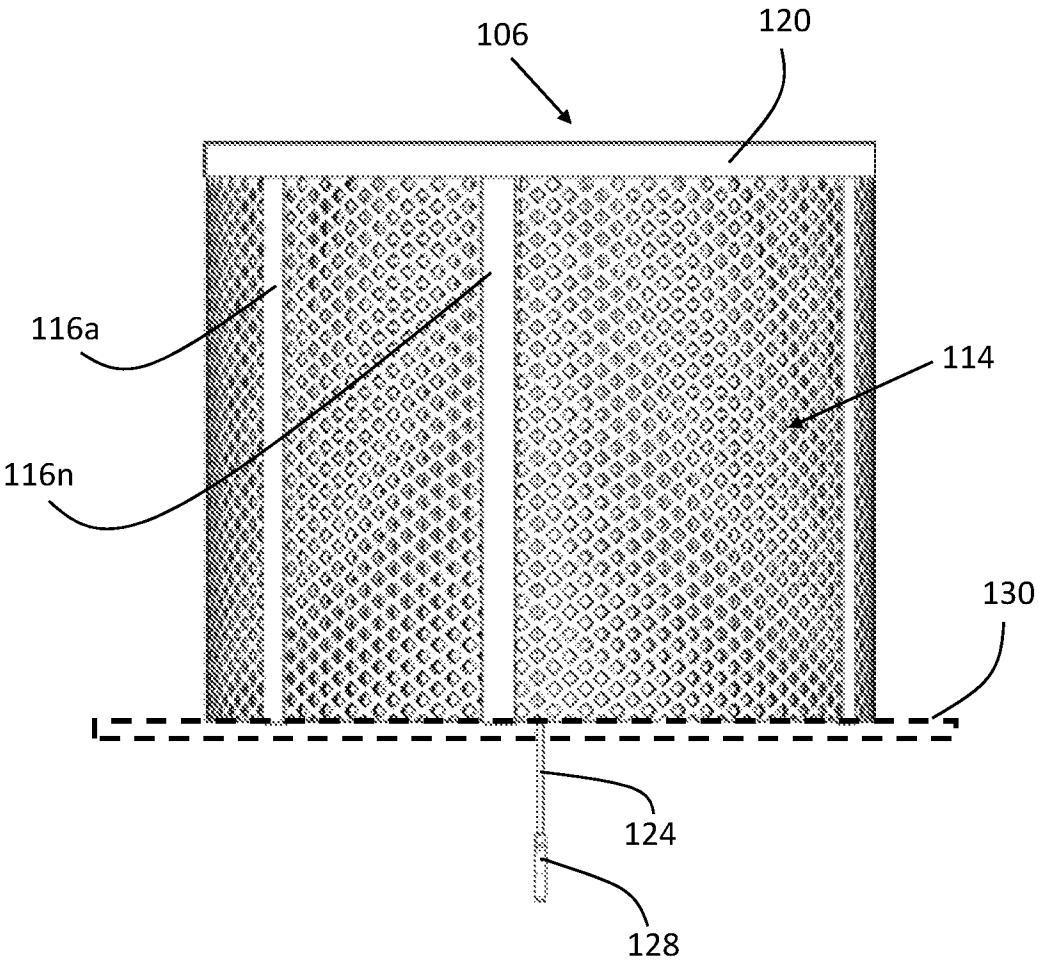
FIG. 6 is an elevated side view of the clothing ejection net, showing the pull cord, in accordance with the present invention.

As FIG. 6 shows, the pull cord 124 is defined by a first end 126 directly coupled to the front wall 110 of the net body 102, and an opposing distal free end 132. However, in other embodiments, the first end 126 of the pull cord 124 attaches to the mesh net sidewall 104. The distal free end 132 is pulled outwardly, away from the front end 108 of the mesh net sidewall 104 to extend the front end to the extended net position 138. The pull cord 124 may include a resilient cable, line, or other flexible material that does not interfere significantly with the washing or drying operation. Nor does the pull string add significant weight to the net body 102.

In another embodiment, a cord magnet 128 couples to the distal free end of the pull cord 124. The cord magnet 128 attaches to the interior surface 704 of the metal drum 702 when the net body 102 is fully inserted into the washer or dryer 700. The magnetic attraction between the cord magnet 128 and the interior surface 704 of the metal drum 702 prevents the free distal end from clanking against the metal drum 702, or tangling with the mesh net sidewall 104. In some embodiments, the cord magnet 128 may be encapsulated by an insulative magnet cover 304 that protects against burning the hand when operating the pull cord 124.

Figure 8:
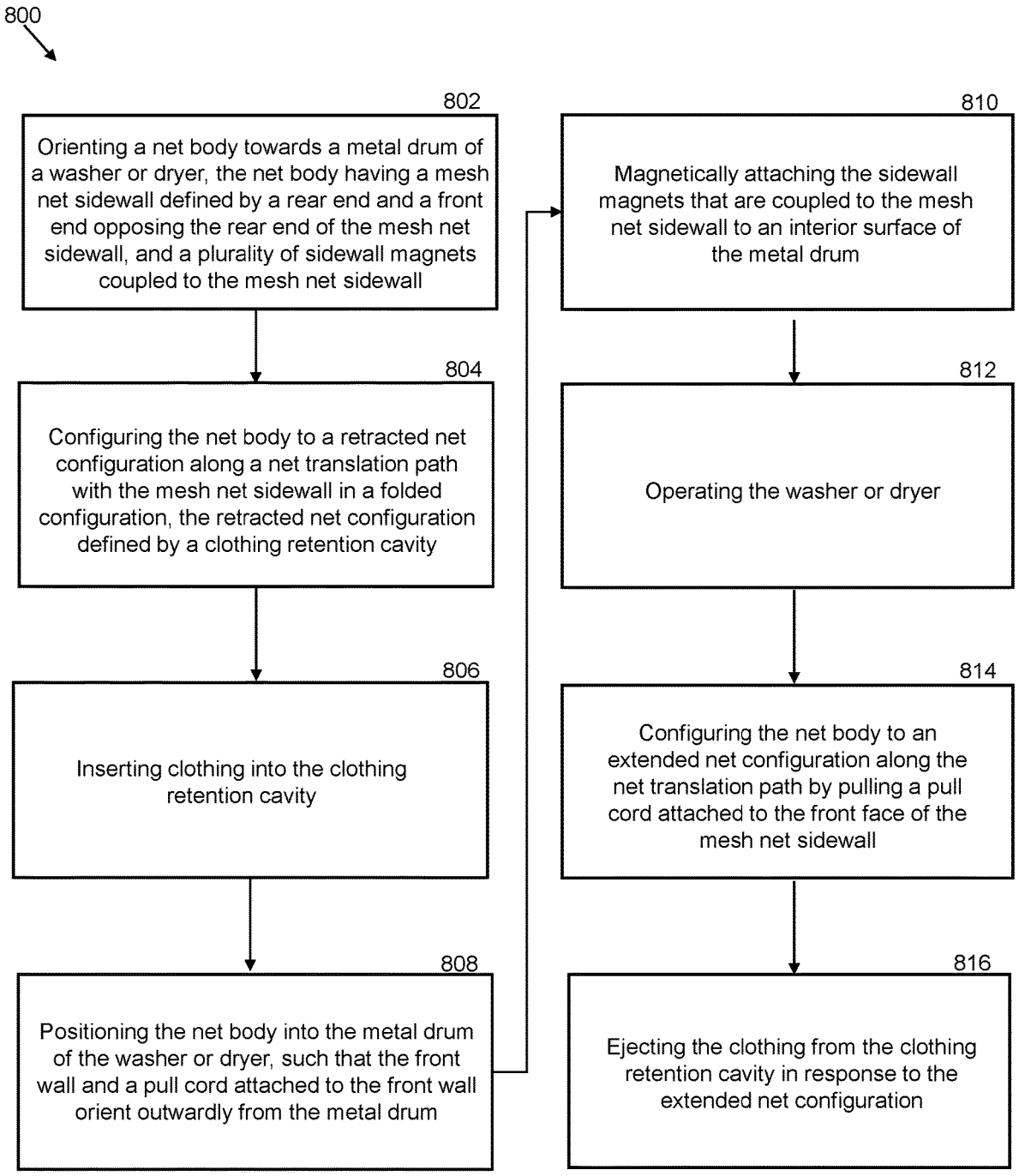
FIG. 8 is a flowchart of an exemplary method for ejecting clothing with a clothing ejection net from a washer or dryer, in accordance with the present invention.

FIG. 8 will be described in conjunction with the process flow chart. Although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process. An exemplary method 800 for ejecting clothing with a clothing ejection net from a washer or dryer, may include an initial Step 802 of orienting a net body towards a metal drum of a washer or dryer, the net body having a mesh net sidewall defined by a rear end and a front end opposing the rear end of the mesh net sidewall, and a plurality of sidewall magnets coupled to the mesh net sidewall and disposed in a longitudinal orientation with respect to one another.

The method 800 may further comprise a Step 804 of configuring the net body to a retracted net configuration along a net translation path with the mesh net sidewall in a folded configuration, the retracted net configuration defined by a clothing retention cavity. The retracted net configuration 202 fits completely into the metal drum 702 while retaining clothing 706. A Step 806 includes inserting clothing into the clothing retention cavity. The clothing may include soiled clothing that requires washing in a washer; or a wet clothing that requires drying in a dryer.

As illustrated in FIG. 7, a Step 808 comprises positioning the net body into the metal drum of the washer or dryer, such that the front wall and a pull cord attached to the front wall orient outwardly from the metal drum. A Step 810 includes magnetically attaching the sidewall magnets that are coupled to the mesh net sidewall to an interior surface of the metal drum. In some embodiments, a Step 812 may include operating the washer or dryer. The net body 102 fits completely in the metal drum 702 during washing or drying operations.

The method 800 may further comprise a Step 814 of configuring the net body to an extended net configuration along the net translation path by pulling a pull cord attached to the front face of the mesh net sidewall. The distal free end 132 is pulled outwardly, away from the front end 108 of the mesh net sidewall 104 to extend the front end to the extended net position 138. A final Step 816 includes ejecting the clothing from the clothing retention cavity in response to the extended net configuration. The force from pulling the pull cord 124 ejects the clothing 706 without requiring reaching into the metal drum 702.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A clothing ejection net for a washer or dryer comprising:

a net body with a mesh net sidewall and operably and selectively configured to have:

an extended net configuration along a net translation path with the mesh net sidewall of a fabric material and having:

a rear end, a front end opposing the rear end of the mesh net sidewall, a front wall with a front wall surface, an outer surface, and an inner surface opposing the outer surface; and a plurality of sidewall magnets coupled to the mesh net sidewall and disposed in a longitudinal orientation with respect to one another; and a retracted net configuration along the net translation path with the mesh net sidewall in a folded configuration having the plurality of sidewall magnets coupled to the mesh net sidewall each magnetically coupled to each other in an overlapping configuration and disposed in the longitudinal orientation to define, with a portion of the outer surface of the mesh net sidewall a clothing retention cavity.

2. The clothing ejection net for a washer or dryer according to claim 1, wherein the retracted net configuration further comprises:

the front end of the mesh net sidewall disposed proximal to the rear end of the mesh net sidewall.

3. The clothing ejection net for a washer or dryer according to claim 2, wherein each of the plurality of sidewall magnets further comprise:

a front surface and a rear surface opposing the front surface of the sidewall magnets, wherein the retracted net configuration includes the front surface of each of the plurality of sidewall magnets directly coupled together.

4. The clothing ejection net for a washer or dryer according to claim 3, wherein:

the plurality of sidewall magnets are formed in the shape of strips.

5. The clothing ejection net for a washer or dryer according to claim 1, wherein:

the folded configuration and the extended net configuration having the plurality of sidewall magnets disposed in a parallel configuration with respect to one another.

6. The clothing ejection net for a washer or dryer according to claim 1, wherein the mesh net sidewall further comprises:

at least one annular shaped magnet coupled thereto and disposed proximal to the rear end of the mesh net sidewall.

7. The clothing ejection net for a washer or dryer according to claim 1, wherein:

the plurality of sidewall magnets are circumferentially disposed around the mesh net sidewall in an equally and uniformly spaced configuration.

8. The clothing ejection net for a washer or dryer according to claim 1, wherein the front wall further comprises:

a plurality of front wall magnets coupled thereto and each disposed in a substantially perpendicular configuration and orientation with respect to at least one of the plurality of sidewall magnets coupled to the mesh net sidewall.

9. The clothing ejection net for a washer or dryer according to claim 1, further comprising:

a pull cord with a first end directly coupled to the front wall of the net body and distal free end.

10. The clothing ejection net for a washer or dryer according to claim 9, wherein:

a cord magnet coupled to the distal free end of the pull cord, the cord magnet being encapsulated by a magnet cover.

11. The clothing ejection net for a washer or dryer according to claim 1, wherein the mesh net sidewall further comprises:

a folding plane defined thereon and bisecting the mesh net sidewall into a drum coupling portion and a retracted portion, wherein the plurality of sidewall magnets disposed on the drum coupling portion are of a stronger magnetic field than the plurality of sidewall magnets disposed on the retracted portion.

12. The clothing ejection net for a washer or dryer according to claim 11, wherein:

the folding plane is defined by an approximate median of a longitudinal length of the mesh net sidewall defined by the rear and front ends thereon when in the extended net configuration.

13. The clothing ejection net for a washer or dryer according to claim 1, wherein:

the front face forms an aperture.

14. The clothing ejection net for a washer or dryer according to claim 1, wherein:

the net body positions inside a metal drum of a washer or dryer in the retracted net configuration, the metal drum being defined by an interior surface.

15. The clothing ejection net for a washer or dryer according to claim 14, wherein:

the plurality of sidewall magnets coupled to the mesh net sidewall magnetically attach to the interior surface of the metal drum in the retracted net configuration.

16. A clothing ejection net for a washer or dryer comprising:

a net body with a mesh net sidewall and operably and selectively configured to have:

an extended net configuration along a net translation path with the mesh net sidewall of a fabric material and having:

a rear end, a front end opposing the rear end of the mesh net sidewall, a front wall with a front wall surface, an outer surface, and an inner surface opposing the outer surface; and a plurality of sidewall magnets coupled to the mesh net sidewall and disposed in a longitudinal orientation with respect to one another, the plurality of sidewall magnets formed in the shape of strips;

a plurality of front wall magnets coupled to the front wall and each front wall magnet disposed in a substantially perpendicular configuration and orientation with respect to at least one of the plurality of sidewall magnets coupled to the mesh net sidewall;

at least one annular shaped magnet coupled to the mesh net sidewall and disposed proximal to the rear end of the mesh net sidewall;

a cord magnet coupled to the distal free end of the pull cord, the cord magnet being encapsulated by a magnet cover; and a retracted net configuration along the net translation path with the mesh net sidewall in a folded configuration having the plurality of sidewall magnets coupled to the mesh net sidewall each magnetically coupled to each other in an overlapping configuration and disposed in the longitudinal orientation to define, with a portion of the outer surface of the mesh net sidewall a clothing retention cavity, the retracted net configuration further comprising the front end of the mesh net sidewall disposed proximal to the rear end of the mesh net sidewall, whereby the net body positions inside a metal drum of a washer or dryer in the retracted net configuration, the metal drum being defined by an interior surface, whereby the plurality of sidewall magnets coupled to the mesh net sidewall magnetically attach to the interior surface of the metal drum in the retracted net configuration.

17. The clothing ejection net for a washer or dryer according to claim 16, wherein:

the plurality of sidewall magnets are circumferentially disposed around the mesh net sidewall in an equally and uniformly spaced configuration.

18. The clothing ejection net for a washer or dryer according to claim 16, wherein the mesh net sidewall further comprises:

a folding plane defined thereon and bisecting the mesh net sidewall into a drum coupling portion and a retracted portion, wherein the plurality of sidewall magnets disposed on the drum coupling portion are of a stronger magnetic field than the plurality of magnets disposed on the retracted portion.

19. The clothing ejection net for a washer or dryer according to claim 18, wherein:

the folding plane is defined by an approximate median of a longitudinal length of the mesh net sidewall defined by the rear and front ends thereon when in the extended net configuration.

20. A method for ejecting clothing in a clothing ejection net from a washer or dryer, comprising:

orienting a net body towards a metal drum of a washer or dryer, the net body having a mesh net sidewall defined by a rear end and a front end opposing the rear end of the mesh net sidewall, and a plurality of sidewall magnets coupled to the mesh net sidewall and disposed in a longitudinal orientation with respect to one another;

configuring the net body to a retracted net configuration along a net translation path with the mesh net sidewall in a folded configuration, the retracted net configuration defined by a clothing retention cavity;

inserting clothing into the clothing retention cavity;

positioning the net body into the metal drum of the washer or dryer, such that the front wall and a pull cord attached to the front wall orient outwardly from the metal drum;

magnetically attaching the sidewall magnets that are coupled to the mesh net sidewall to an interior surface of the metal drum;

operating the washer or dryer;

configuring the net body to an extended net configuration along the net translation path by pulling a pull cord attached to the front face of the mesh net sidewall; and ejecting the clothing from the clothing retention cavity in response to the extended net configuration.

* * * * *